US005408941A

United States Patent [19]

Beiler et al.

[11] Patent Number: 5,408,941

[45] Date of Patent: Apr. 25, 1995

[54] MULTI OIL FURNACE SERVICE DOORS

[75] Inventors: Emanuel S. Beiler, Gordonville; Benuel F. Smoker; David J. Yoder, both of Leola, all of

[73] Assignee: Clean Burn, Inc., Leola, Pa.

[21] Appl. No.: 227,258

[22] Filed: Apr. 14, 1994

[51] Int. Cl.[6] ..... F23B 7/00

[52] U.S. Cl. ..... 110/234; 431/153

[58] Field of Search ..... 110/234, 233; 431/153, 431/154, 11, 28, 207

[56] References Cited

U.S. PATENT DOCUMENTS

| | | | |
|---|---|---|---|
| 1,493,820 | 5/1924 | Miller | 431/207 |
| 1,733,499 | 10/1929 | Klemm | 431/153 |
| 2,841,215 | 7/1958 | Messer | 431/28 |
| 3,070,151 | 12/1962 | Goossens | 431/28 |
| 3,977,823 | 8/1976 | Bernhard | 431/11 |
| 4,162,887 | 7/1979 | Gray | 431/28 |
| 4,460,328 | 7/1984 | Niederholtmeyer | 431/11 |
| 4,877,395 | 10/1989 | Schubach | 431/28 |

FOREIGN PATENT DOCUMENTS

| | | | |
|---|---|---|---|
| 339192 | 12/1930 | United Kingdom | 431/153 |

OTHER PUBLICATIONS

Jun., 1990, Reznor sales brochure for "Waste Oil Heater".

Aug. 25, 1992, Clean Burn Operator's Manual for Models CB-90-AH and CB-90-BH with CB-90-HS Burner.

*Primary Examiner*—Denise L. Gromada

*Attorney, Agent, or Firm*—Larry W. Miller

[57] ABSTRACT

Service doors for a multi oil furnace to improve serviceability are disclosed wherein the multi oil furnace is provided with a hinged front door to provide access to the burner chamber and heat exchanger, while a burner housing is pivotally mounted to the front door to permit movement thereof to gain access to the burner assembly without requiring dismantling of the burner assembly, the burner housing or the front door. A connecting line delivering a flow of used oil to the burner assembly is provided with a rotatable coupling mounted in line with the pivot axis of the burner assembly so that the burner assembly can be accessed for service with a minimum of inconvenience. A power cable delivering electrical power to the burner assembly is mounted such that disconnection of the power cable is required when either the burner housing or the front door is pivotally moved for service of the various components of the multi oil furnace.

18 Claims, 6 Drawing Sheets

MULTI OIL FURNACE SERVICE DOORS

BACKGROUND OF THE INVENTION

This invention relates generally to furnaces for the burning of used oil and, more particularly, to swing out service doors that enhance the serviceability of multi oil furnaces.

Multi oil furnaces are similar to standard oil burning furnaces, but have been adapted to handle oil products that have been previously used in a traditional lubricating operation, such as used crankcase oil up to 50 SAE, used transmission fluid, and even #2, #4 and #5 fuel oils. Such oil products can have significantly varying viscosities and significantly varying burning characteristics, as well. Typically, used oil products are collected into a tank to be supplied to the furnace from a single source. As furnaces are normally operated when the ambient air temperatures are sufficiently cold to warrant the use of the furnace, the supply of used oil to the furnace is normally as cold as the ambient temperature, which requires a preheating of the used oil to more efficiently effect a burning of the used oil products.

The burner nozzle combines a flow of compressed air with the flow of preheated used oil to atomize the used oil and inject a stream of compressed air and atomized used oil droplets into the burner chamber of the multi oil furnace where it is ignited to create a heat source. Known multi oil furnace burner nozzles utilize an in-line burner nozzle configuration coupled directly to the front door of the multi oil furnace. Because of the burning of used oil products, service to the burner nozzle is recommended with regular frequency, particularly to clean the tip of the burner nozzle, and cleaning of ash from the burner chamber and/or heat exchanger is also required periodically.

In known multi oil furnace configurations, access to the burner assembly is cumbersome as the known burner nozzles utilize an in-line burner nozzle configuration coupled directly into the preheater block and are mounted to the furnace cabinet door to be positioned within the air flow stream of combustion air created by an external fan. To gain access for servicing the burner assembly, disassembly of at least part of the burner assembly is required.

Accordingly, improvements to the configuration of the burner assembly are desirable to enhance the convenience of servicing multi oil furnaces.

SUMMARY OF THE INVENTION

It is an object of this invention to improve the serviceability of a multi oil furnaces.

It is another object of this invention to provide a means of servicing the burner assembly of a multi oil furnace without requiring a dismantling of the burner assembly.

It is a feature of this invention that the burner housing mounting the burner assembly therein is pivotable about a hinge axis mounted on the front door of the furnace cabinet.

It is another feature of this invention that the front door of the furnace cabinet is also pivotable to gain access to the interior of the cabinet for service of the components therein.

It is an advantage of this invention that the burner assembly can be serviced without requiring a dismantling of any component of the furnace.

It is another advantage of this invention that the time required for servicing the burner assembly is reduced.

It is still another feature of this invention that the conduit delivering used oil to the burner assembly is provided with a rotatable coupling positioned in line with the hinge axis of the burner housing to allow the burner housing to be pivoted to a inoperative service position without requiring a disconnection of the used oil conduit.

It is still another feature of this invention that the conduit delivering compressed air to the burner assembly is flexible and is connected to a swivel fitting to allow positional displacement whenever the burner housing is pivotally moved to an inoperative service position.

It is still another object of this invention to configure the multi oil furnace components such that electrical power to the burner assembly requires disconnection before any of the components can be moved to a position for servicing.

It is yet another feature of this invention that electrical power is supplied to the burner assembly through a power cable descending from an electrical power source mounted to the furnace cabinet, the power cable being configured to require disconnection before the burner housing can be moved to an inoperative service position.

It is a further feature of this invention that the power cable overlaps the front door such that the power cable requires disconnection before the front door can be opened for servicing the furnace components inside the furnace cabinet.

It is still another advantage of this invention that the entire burner assembly is configured in a modular manner and mounted in separate compartments of the burner housing.

It is yet another object of this invention to provide a service door swing-out system for a multi oil furnace which is durable in construction, inexpensive of manufacture, carefree of maintenance, facile in assemblage, and simple and effective in use.

These and other objects, features, and advantages are accomplished according to the instant invention by providing service doors for a multi oil furnace to improve serviceability wherein the multi oil furnace is provided with a hinged front door to provide access to the burner chamber and heat exchanger, while a burner housing is pivotally mounted to the front door to permit movement thereof to gain access to the burner assembly without requiring dismantling of the burner assembly, the burner housing or the front door. A connecting line delivering a flow of used oil to the burner assembly is provided with a rotatable coupling mounted in line with the pivot axis of the burner assembly so that the burner assembly can be accessed for service with a minimum of inconvenience. A power cable delivering electrical power to the burner assembly is mounted such that disconnection of the power cable is required when either the burner housing or the front door is pivotally moved for service of the various components of the multi oil furnace.

BRIEF DESCRIPTION OF THE DRAWINGS

The advantages of this invention will become apparent upon consideration of the following detailed disclosure of the invention, especially when taken in conjunction with the accompanying drawings wherein.

DETAILED DESCRIPTION OF THE PREFERRED EMBODIMENT

Figure 1:
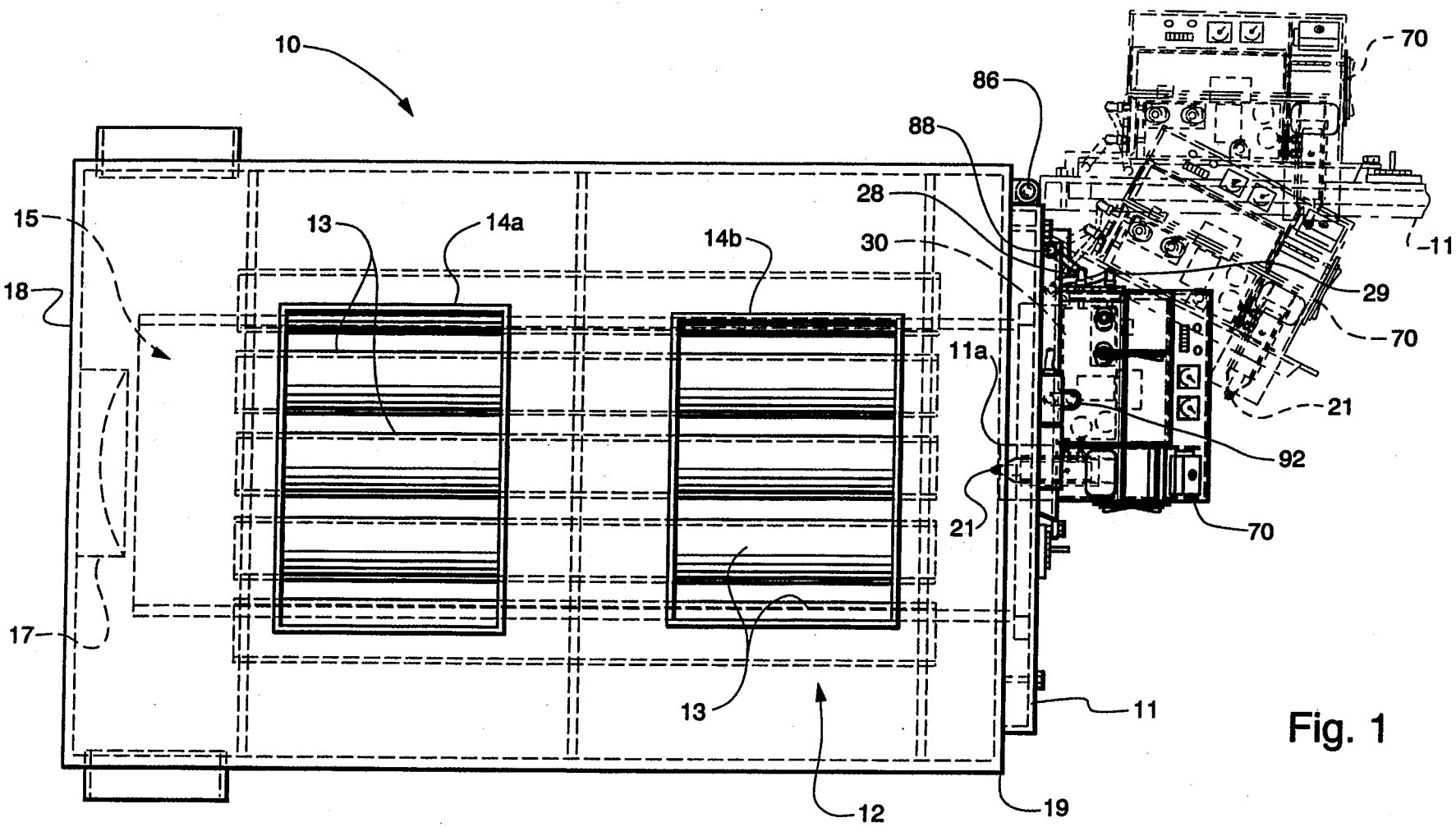
FIG. 1 is a top plan view of a multi oil furnace incorporating the principles of the instant invention, the pivotal movements of the burner housing both moving independently of the front door of the furnace cabinet and moving with the pivotal movement of the front door being shown in phantom.
Figure 2:
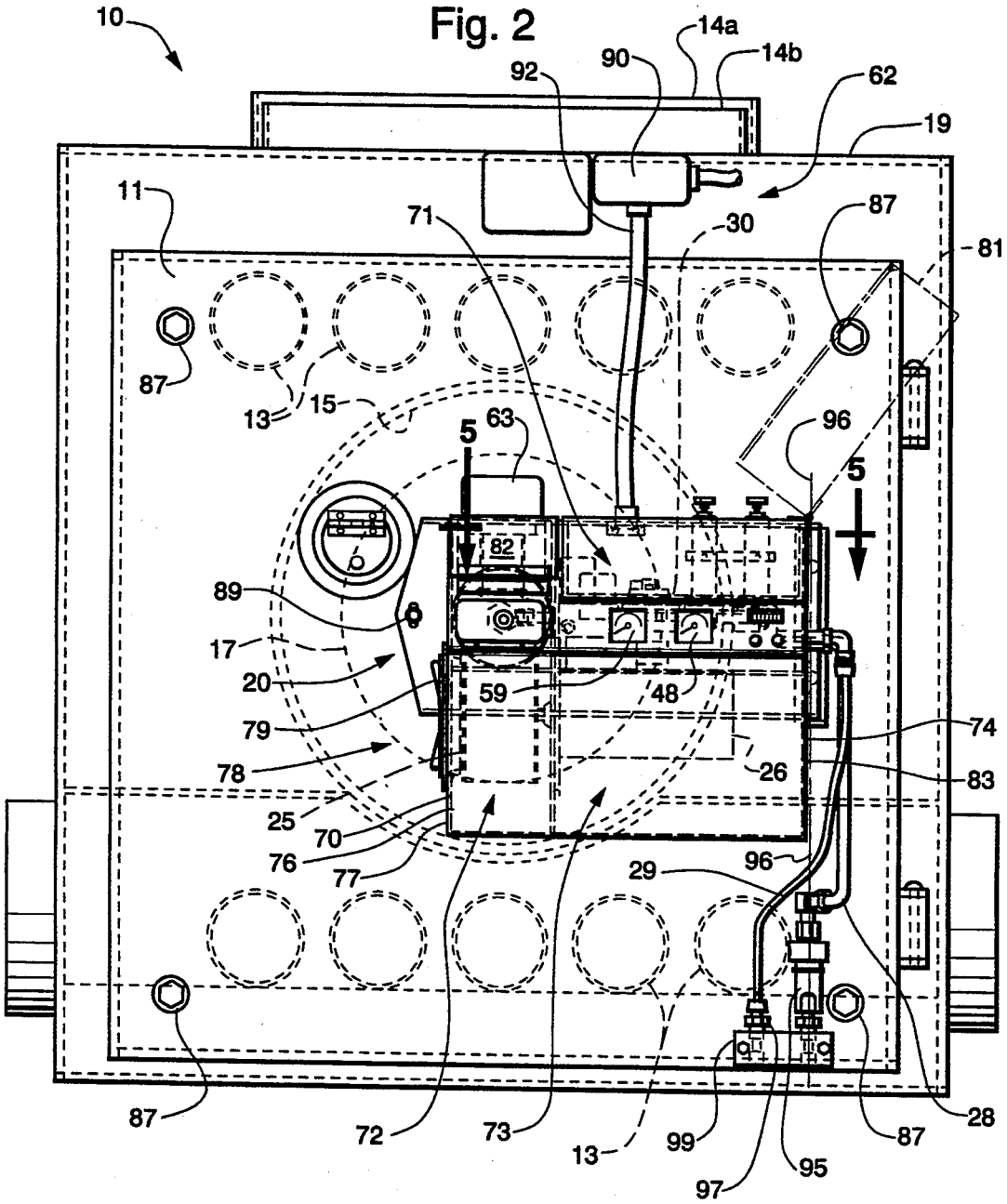
FIG. 2 is a front elevational view of the multi oil furnace shown in FIG. 1, the removable cover for the first housing compartment being depicted in the raised position in phantom.

Referring now to FIGS. 1 and 2, a top plan and front elevational views of a multi oil furnace incorporating the principles of the instant invention can best be seen. The furnace 10 includes a cabinet shell 19 enveloping a heat exchanger 12 and a central burner chamber 15. A burner assembly 20 is mounted on the front door 11 to fire a flame into the burner chamber 15 toward a target 17 mounted on the back wall 18 of the burner chamber 15. The heat exchanger 12 allows the circulation of clean air to be heated around pipes 13 carrying heated combustion gases before being discharged from the furnace 12. The furnace 12 incorporates a ventilation air inlet opening 14*a* and a ventilation air exit opening 14*b* to provide for the passage of the clean ventilation air to be heated through the heat exchanger 12.

Figure 3:
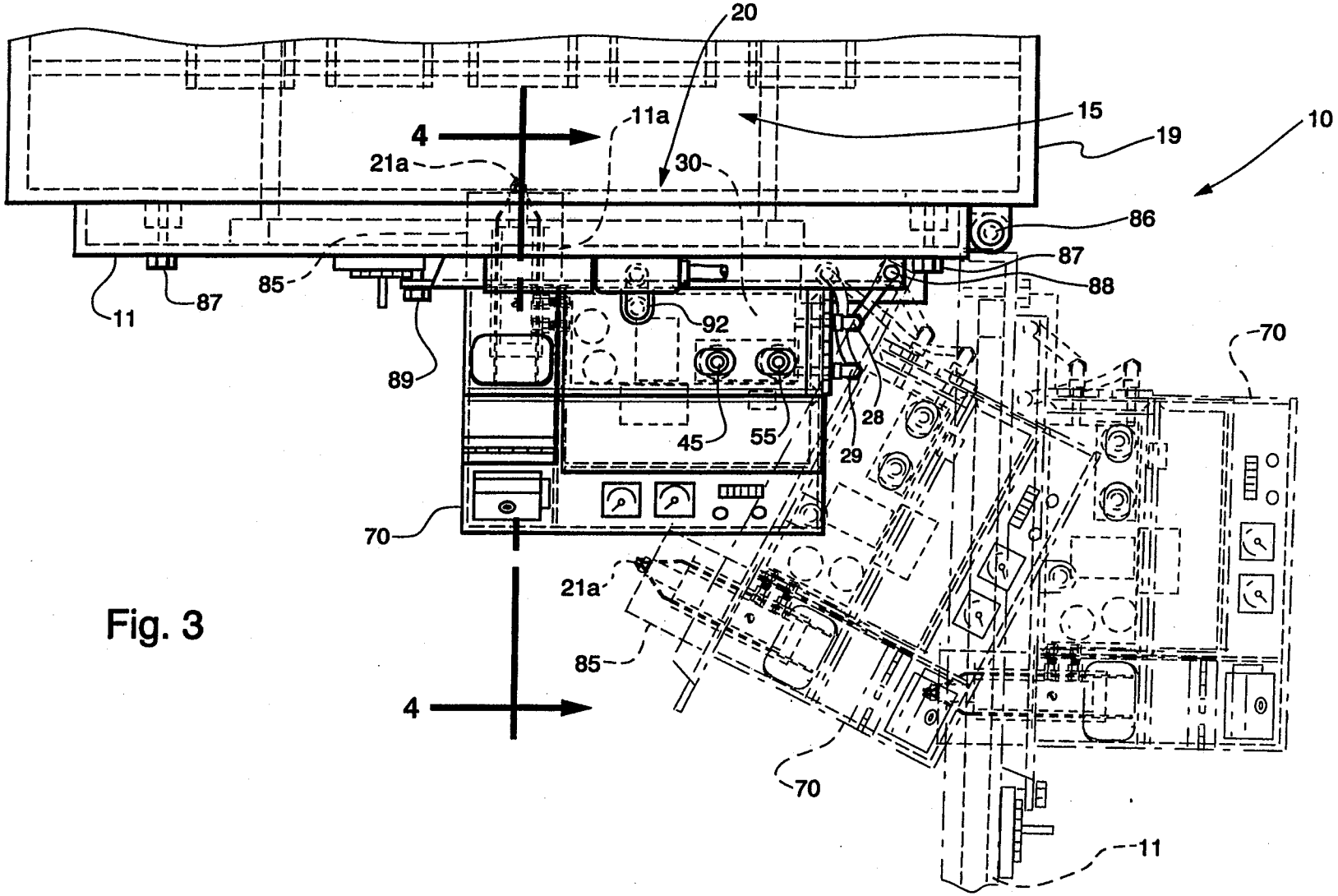
FIG. 3 is an enlarged top plan view of the pivotally mounted front door of the furnace cabinet and the pivotally mounted burner housing, similar to the view of FIG. 1, with the pivotal movements of the burner housing and the front door being shown in phantom.
Figure 4:
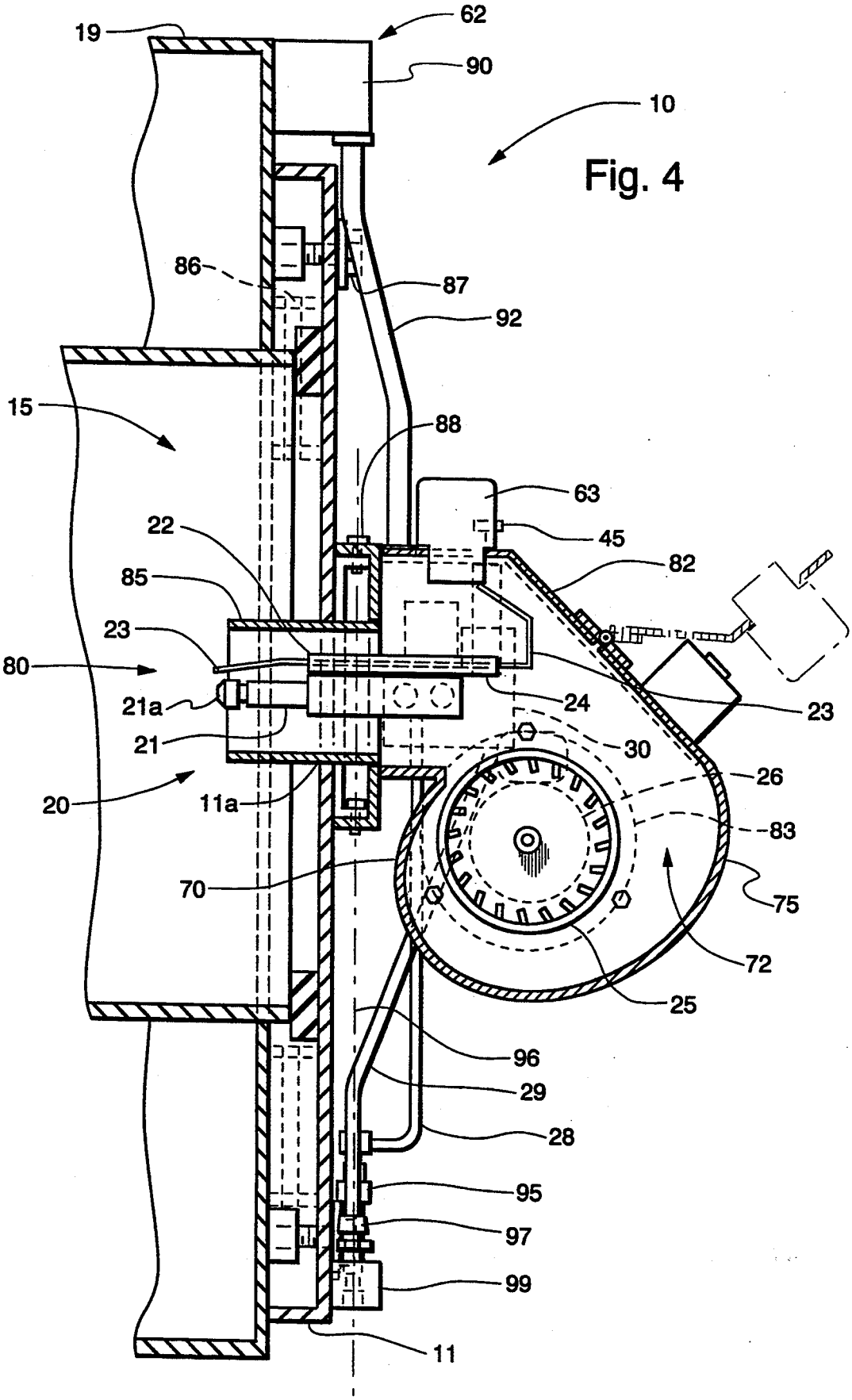
FIG. 4 is an enlarged cross-sectional view of the multi oil furnace taken along lines 4—4 of FIG. 3 to better show the burner assembly.
Figure 5:
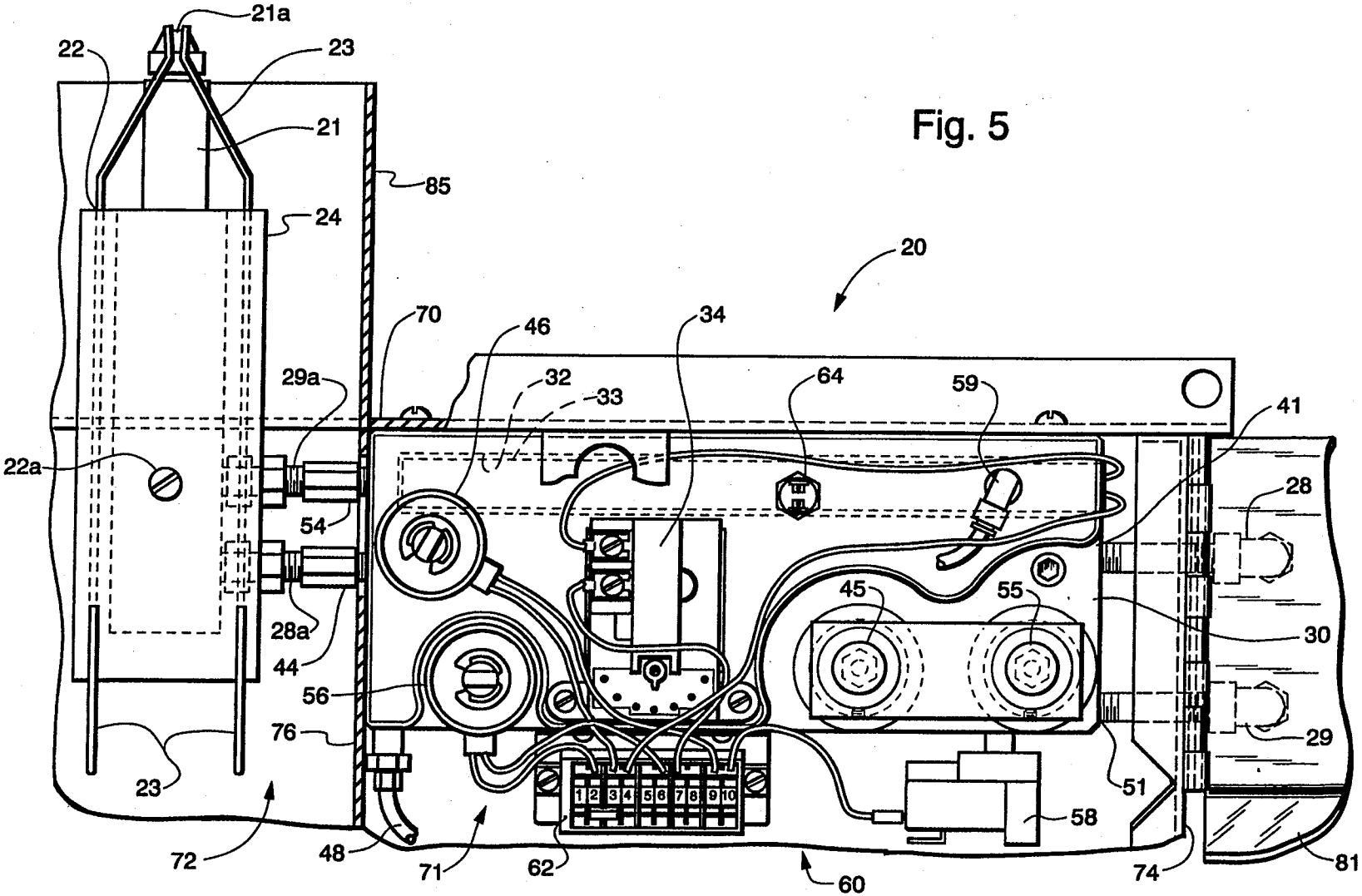
FIG. 5 is an enlarged partial cross-sectional view of the burner assembly taken along lines 5—5 of FIG. 2 to depict a top view of the preheater block.

Referring now to the views of FIGS. 3, 4 and 5, the details of the burner assembly 20 can best be seen. The burner assembly 20 includes a burner nozzle 21 and an igniter 22 to create a flame from the used oil supplied thereto, as described in greater detail below, a combustion air fan 25 and associated motor 26, and a preheater block 30 mounting various controls for the flow of used oil and compressed air to the burner nozzle 21, as will also be described in greater detail below. The burner assembly 20 is mounted within a burner housing 70, as will also be described in greater detail below.

The preheater block 30 defines two separate flow paths for used oil and compressed air, respectively. The preheater block 30 is formed with a heater chamber 32 in which is housed a heating element 33, electrically coupled to a preheater thermostat 34 and a power supply 62. The heating element 33 is removably mounted within the heater chamber 32 and provides a source of heat when electrical current is passed through the heating element 33. The preheater block 30 is formed of metallic material, such as aluminum, and is, therefore, conductive of the heat generated by the heating element 33.

The flow of used oil is introduced into the preheater block 30 from the line 28 delivering unheated used oil from an external tank (not shown) to the inlet port 41. The flow path for the used oil through the preheater block 30 makes approximately seven passes through the block 30 before exiting the outlet port 44 to absorb conductive heat to enable the delivery of used oil preheated to a predetermined temperature to the burner nozzle 21.

An oil flow regulator 45 is manually operable to control the rate of flow of used oil through the block 30 and, therefore, to the burner nozzle 21. A solenoid shut-off mechanism 46 is coupled to the oil flow path immediately adjacent the oil outlet port 44 to minimize the amount of used oil that can drip through the burner nozzle 21. An oil pressure gauge 48 is tapped into the oil flow path down stream from the solenoid shut-off 46 to register the flow of used oil to the burner nozzle 21.

The flow of compressed air is introduced into the preheater block 30 through the air inlet port 51 from a connecting line 29 couple to a conventional source of compressed air (not shown). The flow path for the compressed air through the preheater block 30 makes approximately three passes through the block 30 to absorb sufficient conductive heat from the block 30 to raise the temperature to approximately the same level as the used oil before exiting the outlet port 54 for delivery of preheated compressed air to the burner nozzle 21. An air flow regulator 55 is manually operable to control the flow of compressed air through the block 30.

A solenoid shut-off mechanism 56 is operable to halt the flow of compressed air through the system. An air pressure gauge 59 is tapped into the compressed air flow path down stream from the solenoid shut-off 56 to register the flow of compressed air to the burner nozzle 21. An air sensing switch 58 detects the presence of compressed air flowing to the burner nozzle 21 and is operable to prevent the oil solenoid shut-off 46 from opening whenever compressed air is not present in the system.

Referring now to FIGS. 1–4, the burner housing 70 is divided into three compartments 71, 72 and 73, respectively, to improve serviceability of the controls and operative components of the furnace 10. The preheater block 30 and associated operative controls are supported in the first housing compartment 71. The used oil connecting line 28 and the compressed air connecting line 29 pass through corresponding openings in the right side wall 74 to connect with the respective inlet ports 41, 51 of the preheater block 30. Similarly, the interior wall 76 separating the first and second housing compartments 71, 72 is provided with appropriate openings for the passage of the connecting lines 28*a*, 29*a* for the supply of preheated used oil and compressed air, respectively, to the burner nozzle 21.

The burner nozzle 21 is supported from the preheater block 30 in a cantilever fashion by the connecting lines 28*a*, 29*a* supplying preheated used oil and compressed air to the burner nozzle 21 and is positioned within the second housing compartment 72, separated from the first housing compartment 71 by the interior wall 76. The function of the nozzle 21 is to combine the flows of compressed air and used oil from the preheater block 30 to create a stream of compressed air and atomized used oil droplets to be ejected from the nozzle 21 into the burner chamber 15. The igniter 22 is detachably mounted to the burner nozzle 21 by the fastener 22*a* to locate the igniter electrodes 23 in the proper position relative to the nozzle 21 for ignition of the stream of compressed air and atomized used oil droplets.

A fan 25 for supplying quantities of combustion air into the burner chamber 15 is rotatably mounted in the second housing compartment 72 below the burner nozzle 21. The rotatable fan 25 draws combustion air from the atmosphere around the furnace 10 through an air inlet opening 78 in the left side wall 77. Adjustment louvers 79 are movable relative to the left side wall 77 to control the effective size of the air inlet opening 78 and, thereby, control the volume of combustion air being blown into the burner chamber 15. The curved outer peripheral surface 75 of the second compartment 72 directs the flow of combustion air over the burner nozzle 21 and through the discharge opening 80 into the burner chamber 15 to provide sufficient oxygen to support the burning of the flame therein.

Each of the housing compartments 71, 72 and 73, is provided with its own removable cover 81, 82 and 83, respectively. The first compartment cover 81 is hinged to the right side wall 74 and opens to expose the entire preheater block 30 and attached components for servicing, testing, etc. The first compartment cover 81 has a pair of apertures through the top surface to expose the oil and air regulators 45, 55 for manual manipulation without requiring the cover 81 to be opened. The third compartment cover 83 is simply attached to the right side wall 74 to cover an access opening therein to allow access to the fan motor 26.

The second compartment cover 82 is hinged to and forms a portion of the curved outer peripheral portion 75 of the second compartment 72. A power transformer 63, which receives electrical power from the primary source of electrical power 62, is mounted on the second compartment cover 82 and operatively extends into the second housing compartment 72. The electrodes 23 of the igniter 22 extend upwardly from the insulator block 24 to contact the power transformer 63 and receive electrical current therefrom to ignite the stream of compressed air and used oil droplets ejected from the burner nozzle 21 by creating a spark in a conventional manner.

Whenever the second compartment cover 82 is lifted to provide access to the burner nozzle 21 and igniter 22 for service thereof, the transformer 63 is disconnected from the electrodes 23, but also has contact broken with the primary power source 62. One skilled in the art will readily realize that once the flame has started, the continuous ejection of the stream of compressed air and atomized used oil droplets will be self-igniting and does not require the use of the power transformer 63 to continue operation of the furnace 10. Regular maintenance of the burner assembly 20 includes an annual replacement of the igniter 22. One skilled in the art will readily recognize that access to the igniter 22 and inspection of both the burner nozzle 21 and the combustion air fan 25 is conveniently available through the second compartment cover 82.

By use of the compartmentalized burner housing 70, access to the preheater block 30 and associated components and to the combustion air fan motor 26 can be attained without disrupting the flow of combustion air within the second housing compartment 72 over the burner nozzle 21 and igniter 22 to the burner chamber 15. Furthermore, the separation of the operative components from the combustion air flow minimizes the exposure of these components to the dust and dirt that is associated with the supply of combustion air and to the oxidizing effects of the proximate open flame. The operative gauges, such as the oil pressure gauge 48 and the air pressure gauge 59, can be mounted to the exterior of the housing 70 for readability without moving a compartment cover 81–83.

Referring now to FIGS. 1, 2 and 3, it can be seen that the front door 11 is pivotally connected to the cabinet shell 19 by door hinges 86 and is pivotally movable between a closed position, in which the front door 11 is bolted to the cabinet shell 19 by bolts 87, as shown in solid lines in FIGS. 1, 2 and 3, and an opened position, as shown in phantom in FIGS. 1 and 3. The movement of the front door 11 to the opened position allows access to the burner chamber 15 and the heat exchanger 12 for service or repairs thereto. The burner housing 70, which is mounted to the front door 11, as described in greater detail below, swings outwardly with the front door 11.

The burner housing 70, in which is mounted the burner assembly 20, as described above, is pivotally mounted to the front door 11 by housing hinges 88 which enable the burner housing 70 to be pivotally moved between a closed operative position shown in solid lines in FIGS. 1, 2 and 3 and an opened inoperative or service position shown in phantom lines in FIGS. 1 and 3. When in the operative position, the burner housing 70 is fastened to the front door 11 by the fastener 89 to prevent and accidental opening of the burner housing 70 while the furnace 10 is operating.

Particularly in multi oil furnaces where used oils are burned, a regular maintenance duty is to clean the tip **21*a* of the burner nozzle 21. One skilled in the art can readily see that cleaning the burner nozzle tip 21*a* is a relatively simple task involving the removal of the fastener 89 and the swinging outwardly of the burner housing 70 about the housing hinges 88 to expose the tip 21*a* for servicing or replacement, if necessary. The front door 11 is provided with a burner opening 11*a* for insertion of the burner tube 85 defining the discharge opening 80 therethrough to expose the burner nozzle tip 21*a* to the burner chamber 15 for the firing of a flame toward the target 17. The burner housing 70 seals against the front door 11** when in the operative position.

The primary power supply 62 is shown in the form of a junction box 91 affixed to the cabinet shell 19 above the front door 11. Electrical power is transferred to the burner assembly 20 by a power cable 92 extending downwardly, overlapping the front door 11, for connection to the control system 60 for the burner assembly 20. The power cable 92 is configured so as to take the shortest possible route between the junction box 90 and the burner assembly 20. As a result, any movement of the burner housing 70, whether associated with the pivotal movement about the door hinges 86 with the front door 11 or with the housing hinges 88 independently of the front door 11, moves the burner housing 70, and the burner assembly 20 mounted therein, away from the junction box 90.

Since the power cable 92 cannot accommodate the increase in distance, the power cable 92 must be disconnected from the junction box 90, or preferably from the burner assembly 20, to enable the burner housing 70 to swing out for servicing. Accordingly, electrical power to the burner assembly 20 will necessarily be disconnected whenever the burner housing is moved for servicing any component of the furnace 10, including movements associated with the movement of the front door to the opened position.

Referring now to FIGS. 2 and 4, it can be seen that the used oil supply line 28 includes a rotatable coupling 95, preferably a conventional quick disconnect coupling, mounted to a connector block 99 in line with the pivot axis 96 coinciding with the housing hinges 88 about which the burner housing 70 pivots when moving to the inoperative or service position independently of the front door 11. Accordingly, whenever the burner housing 70 moves about the pivot axis 96 relative to the front door 11, the used oil connecting line 28, which is preferably a rigid copper tube, can rotate about the rotatable coupling 95 and not require disconnection to swing the burner housing 70 for servicing the burner nozzle tip 21*a*.

The compressed air supply line 29 is preferably flexible black nylon tubing, but is nevertheless connected to a swivel fitting 97, supported by the connector block 99 adjacent the rotatable coupling 95, to allow some positional displacement of the compressed air connecting line 29 when the burner housing 70 is pivoted to the inoperative position because the swivel fitting 97 is not aligned with the pivot axis 96. The connector block 99 is fixed to the bottom of the front door 11 for connection to appropriate supply lines to remote sources of used oil and compressed air.

While the used oil connecting line 28 and the compressed air connecting line 29 do not have to be disconnected from the connecting block 99 whenever the burner housing 70 is moved relative to the front door 11, the pivotal movement of the front door 11 about the door hinges 86 will normally require a disconnection of the remote supply lines for both the used oil and compressed air. The connector block 99 and connecting lines 28, 29 are utilized to standardize the furnace system beginning with the connector block 99, as the typical installation of a furnace 10 will require an on-site connection of the remote supply lines to the connector block 99.

Figure 6:
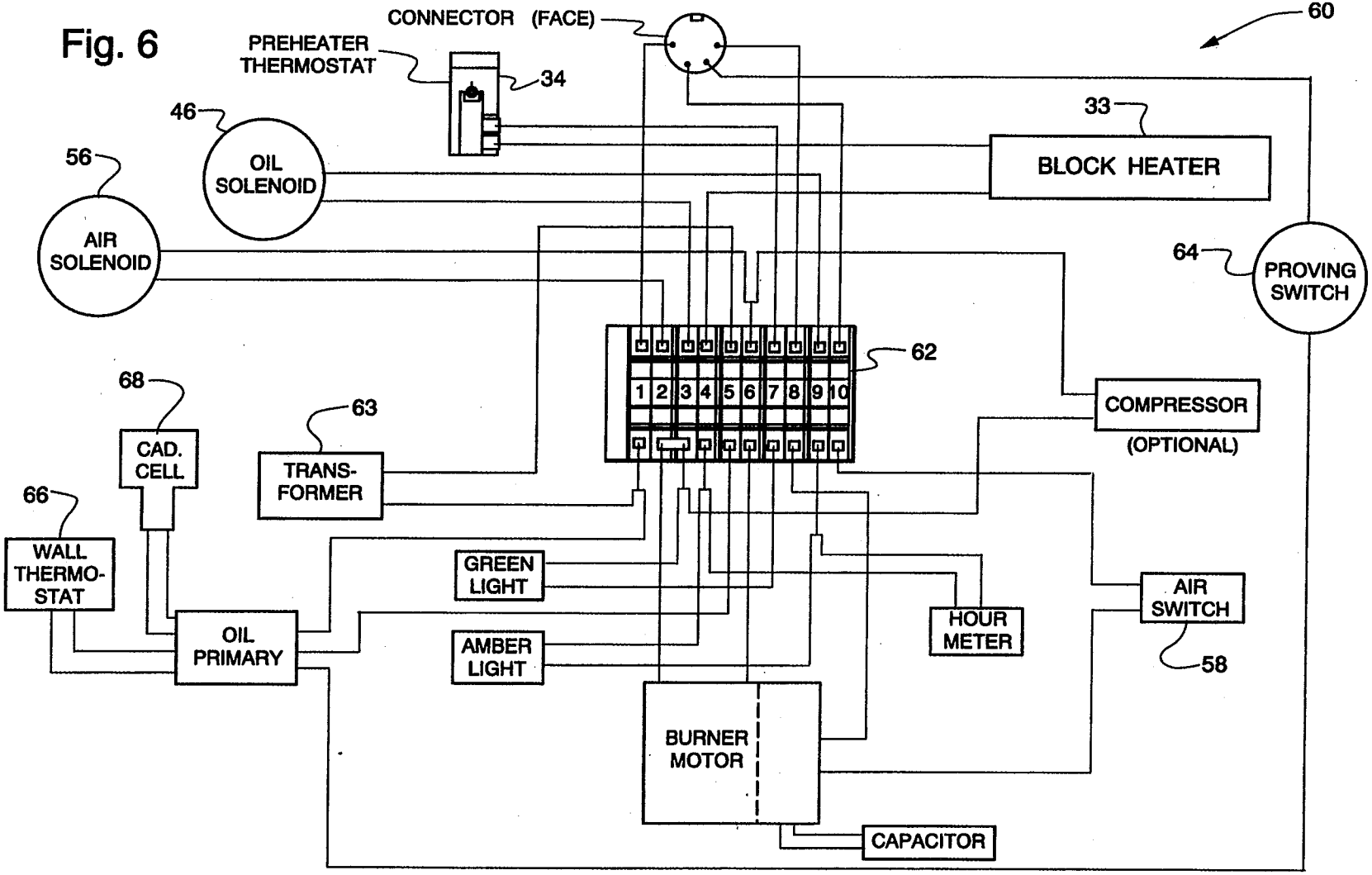
FIG. 6 is a schematic wiring diagram of the electrical circuit for the multi oil furnace.

Referring now to the schematic electrical wiring diagram of FIG. 6, several of the safeguards incorporated into the operation of the multi oil furnace 10 can be seen. The control mechanism 60 operatively interconnects several switches and sensors to control the operation of the furnace 10. For example, if the flow of compressed air is interrupted through the air flow path 50, as sensed by the air sensing switch or the de-energizing of the air solenoid shut-off valve 56, the oil solenoid shut-off valve 46 is immediately de-energized to stop the flow of used oil through the oil flow path 40 to the burner nozzle 21.

A proving switch 64 is mounted on the preheater block 30 and will not allow the furnace 10 to operate unless the preheater block 30 has been warmed to the predetermined temperature by the heating element 33. A CAD cell 68 is operable to detect the existence of a flame within the burner chamber 15. The control mechanism 60 will automatically de-energize the air and oil solenoid shut-off valves 46, 56 if a flame in the burner chamber 15 is not detected immediately after heat is called for by the wall thermostat 66.

It will be understood that changes in the details, materials, steps, and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description may be employed in other embodiments without departing from the scope of the invention. Accordingly, the following claims are intended to protect the invention broadly as well as in the specific form shown.

Having thus described the invention, what is claimed is:

1. In a multi oil furnace having an external cabinet shell; a burner chamber supported within said cabinet shell for the burning of a flame therewithin to generate heat; a heat exchanger supported within said cabinet shell and being operably associated with said burner chamber to extract heat therefrom; a front door pivotally supported on said cabinet shell and movable between a closed position and an opened position in which said heat exchanger and said burner chamber are exposed for access thereto, said front door having a burner hole therein aligned with said burner chamber; a burner assembly mounted on said front door and being operable to ignite a combined flow of compressed air and used oil to fire a flame through said burner opening into said burner chamber; means for supplying a flow of used oil including a used oil conduit interconnecting a remote supply of used oil and said burner assembly; and means for supplying a flow of compressed air including an air conduit interconnecting a source of compressed air and said burner assembly, the improvement comprising:

said burner assembly being mounted in a burner housing pivotally supported on said front door for movement between a closed operative position and an opened inoperative position about a hinge supported on said front door and defining a generally vertical pivot axis, said used oil conduit including a rotatable coupling mounted to said front door in alignment with said vertical pivot axis to permit said front door to pivotally move without disconnection of said used oil conduit and allow access to said burner assembly for service thereof without requiring a dismounting of said burner assembly from said front door and without requiring a pivotal movement of said front door to further expose said burner chamber and said heat exchanger.

2. The multi oil furnace of claim 1 wherein said rotatable coupling is a quick disconnect coupling.

3. The multi oil furnace of claim 2 wherein said air conduit is a flexible conduit connected to a swivel fitting permitting positional displacement when said burner housing is moved from said closed operative position to said opened inoperative position.

4. The multi oil furnace of claim 3 wherein both said quick disconnect coupling and said swivel fitting are attached to a connector block fastened to said front door, said connector block being coupled to said remote supplies of used oil and compressed air by respective connector lines, said connector lines requiring disconnection from said connector block to enable said front door to be moved from said closed position to said opened position.

5. In a multi oil furnace having an external cabinet shell; a burner chamber supported within said cabinet shell for the burning of a flame therewithin to generate heat; a heat exchanger supported within said cabinet shell and being operably associated with said burner chamber to extract heat therefrom; a front door pivotally supported on said cabinet shell and movable between a closed position and an opened position in which said heat exchanger and said burner chamber are exposed for access thereto, said front door having a burner hole therein aligned with said burner chamber; a burner assembly mounted on said front door and being operable to ignite a combined flow of compressed air and used oil to fire a flame through said burner opening into said burner chamber; means for supplying a flow of used oil including a used oil conduit interconnecting a remote supply of used oil and said burner assembly; and means for supplying a flow of compressed air including an air conduit interconnecting a source of compressed air and said burner assembly, the improvement comprising:

said burner assembly being mounted in a burner housing pivotally supported on said front door for movement between a closed operative position and an opened inoperative position to permit access to said burner assembly for service thereof without requiring a dismounting of said burner assembly from said front door;

an electrical power source mounted on said cabinet shell; and a power cable interconnecting said electrical power source and said burner assembly, said power cable being sufficiently long to interconnect said electrical power source and said burner assembly when said burner housing is in said closed operative position, but not sufficiently long such that said burner housing can be moved to said opened inoperative position without disconnecting said power cable from either said electrical power source or said burner assembly, whereby said burner assembly is electrically disconnecfed whenever said burner housing is pivotally moved to said inoperative position for servicing said burner assembly.

6. The multi oil furnace of claim 5 wherein said power cable overlaps said front door such that a movement of said front door from said closed position to said opened position also requires a disconnection of said power cable from either said electrical power source or said burner assembly, whereby said burner assembly is electrically disconnected whenever said front door is pivotally moved to said opened position for servicing said burner chamber and said heat exchanger.

7. The multi oil furnace of claim 6 wherein said burner assembly comprises:

a preheater block to preheat the flow of used oil and the flow compressed air for delivery to said burner nozzle;

a burner nozzle aligned with said burner hole combine said flows of compressed air and preheated used oil to eject a stream of compressed air and atomized used oil droplets into said burner chamber;

an igniter positioned adjacent said burner nozzle to ignite the stream of compressed air and atomized used oil droplets, said igniter including electrodes electrically couple to said electrical power source; and means for supplying combustion air over said burner nozzle, through said burner opening into said burner chamber for efficient burning of said stream of compressed air and atomized used oil droplets, said means for supplying combustion air including a fan operable to blow air into said burner chamber and a fan motor operably connected to said fan for rotation thereof.

8. The multi oil furnace of claim 7 wherein said front door is detachably fastened to said cabinet shell by bolts when in said closed position, said burner housing being detachably fastened to said front door by a bolt when in said operative position.

9. A multi oil furnace comprising:

an external cabinet shell;

a burner chamber supported within said cabinet shell for the burning of a flame therewithin to generate heat;

a heat exchanger supported within said cabinet shell and being operably associated with said burner chamber to extract heat therefrom;

a front door pivotally supported on said cabinet shell and pivotally movable about a door pivot axis between a closed position and an opened position in which said heat exchanger and said burner chamber are exposed for access thereto, said front door having a burner hole therein aligned with said burner chamber;

a burner housing pivotally supported on said front door for pivotal movement about a generally vertical hinge axis between a closed operative position and an opened inoperative position;

a burner assembly mounted in said burner housing and movable therewith, said burner assembly being operable to ignite a combined flow of compressed air and used oil to fire a flame through said burner opening into said burner chamber, the movement of said burner housing to said inoperative position permitting access to said burner assembly for service thereof without requiring a dismounting of said burner assembly from said front door;

means for supplying a flow of used oil to said burner assembly including a used oil conduit interconnecting a remote supply of used oil and said burner assembly and having a rotatable coupling mounted to said front door along said vertical pivot axis; and means for supplying a flow of compressed air to said burner assembly including a flexible air conduit interconnecting a source of compressed air and said burner assembly, said flexible air conduit being connected to a swivel fitting mounted on said front door to permit positional displacement when said burner housing is moved from said closed operative position to said opened inoperative position.

10. The multi oil furnace of claim 9 further comprising:

an electrical power source mounted on said cabinet shell; and a power cable interconnecting said electrical power source and said burner assembly, said power cable being sufficiently long to interconnect said electrical power source and said burner assembly when said burner housing is in said closed operative position, but not sufficiently long such that said burner housing can be moved to said opened inoperative position without disconnecting said power cable from either said electrical power source or said burner assembly, whereby said burner assembly is electrically disconnected whenever said burner housing is pivotally moved to said inoperative position for servicing said burner assembly.

11. The multi oil furnace of claim 10 wherein said power cable overlaps said front door such that a movement of said front door from said closed position to said opened position also requires a disconnection of said power cable from either said electrical power source or said burner assembly, whereby said burner assembly is electrically disconnected whenever said front door is pivotally moved to said opened position for servicing said burner chamber and said heat exchanger.

12. The multi oil furnace of claim 11 further comprising a connecter block mounted to said front door, said connector block supporting said rotatable coupling and said swivel fitting and being coupled to said remote supplies of used oil and compressed air by respective connector lines, said connector lines requiring disconnection from said connector block to enable said front door to be moved from said closed position to said opened position.

13. A multi oil furnace comprising:

an external cabinet shell;

a burner chamber supported within said cabinet shell for the burning of a flame therewithin to generate heat;

a heat exchanger supported within said cabinet shell and being operably associated with said burner chamber to extract heat therefrom;

a front door pivotally supported on said cabinet shell and pivotally movable about a door pivot axis between a closed position and an opened position in which said heat exchanger and said burner chamber are exposed for access thereto, said front door having a burner hole therein aligned with said burner chamber;

a burner housing pivotally supported on said front door for pivotal movement about a generally vertical hinge axis between a closed operative position and an opened inoperative position;

a burner assembly mounted in said burner housing and movable therewith, said burner assembly being operable to ignite a combined flow of compressed air and used oil to fire a flame through said burner opening into said burner chamber, the movement of said burner housing to said inoperative position permitting access to said burner assembly for service thereof without requiring a dismounting of said burner assembly from said front door;

means for supplying a flow of used oil to said burner assembly including a used oil conduit interconnecting a remote supply of used oil and said burner assembly;

means for supplying a flow of compressed air to said burner assembly including an air conduit interconnecting a source of compressed air and said burner assembly;

an electrical power source mounted on said cabinet shell; and a power cable interconnecting said electrical power source and said burner assembly, said power cable being sufficiently long to interconnect said electrical power source and said burner assembly when said burner housing is in said closed operative position, but not sufficiently long such that said burner housing can be moved to said opened inoperative position without disconnecting said power cable from either said electrical power source or said burner assembly, so that said burner assembly is electrically disconnected whenever said burner housing is pivotally moved to said inoperative position for servicing said burner assembly, said power cable overlapping said front door such that a movement of said front door from said closed position to said opened position also requires a disconnection of said power cable from either said electrical power source or said burner assembly, whereby said burner assembly is electrically disconnected whenever said front door is pivotally moved to said opened position for servicing said burner chamber and said heat exchanger.

14. The multi oil furnace of claim 13 wherein said used oil conduit includes a rotatable coupling mounted on said front door along said vertical hinge axis to permit rotation of said used oil conduit when said burner housing is moved from said operative position to said inoperative position.

15. The multi oil furnace of claim 14 wherein said air conduit is a flexible conduit connected to a swivel fitting to permit positional displacement when said burner housing is moved from said closed operative position to said opened inoperative position.

16. The multi oil furnace of claim 15 wherein both said rotatable coupling and said swivel fitting are attached to a connector block fastened to said front door, said connector block being coupled to said remote supplies of used oil and compressed air by respective connector lines, said connector lines requiring disconnection from said connector block to enable said front door to be moved from said closed position to said opened position.

17. The multi oil furnace of claim 16 wherein said burner assembly comprises:

a preheater block to preheat the flow of used oil and the flow compressed air for delivery to said burner nozzle;

a burner nozzle aligned with said burner hole combine said flows of compressed air and preheated used oil to eject a stream of compressed air and atomized used oil droplets into said burner chamber;

an igniter positioned adjacent said burner nozzle to ignite the stream of compressed air and atomized used oil droplets, said igniter including electrodes electrically couple to said electrical power source; and means for supplying combustion air over said burner nozzle, through said burner opening into said burner chamber for efficient burning of said stream of compressed air and atomized used oil droplets, said means for supplying combustion air including a fan operable to blow air into said burner chamber and a fan motor operably connected to said fan for rotation thereof.

18. The multi oil furnace of claim 16 wherein said front door is detachably fastened to said cabinet shell by bolts when in said closed position, said burner housing being detachably fastened to said front door by a bolt when in said operative position.

* * * * *